US005570076A

United States Patent [19]

Erickson et al.

[11] Patent Number: 5,570,076

[45] Date of Patent: Oct. 29, 1996

[54] VARIABLE RESISTANCE DEVICE

[76] Inventors: Bruce L. Erickson, 11732 Winnetka Ave. N., Champlin, Minn. 55316; Alan H. Stull, 14963 Nowthen Blvd., Ramsey, Minn. 55303

[21] Appl. No.: 276,536

[22] Filed: Jul. 18, 1994

[51] Int. Cl.[6] ..... H01C 10/32

[52] U.S. Cl. ..... 338/163; 338/162; 338/202; 338/175; 338/143; 338/157; 338/150

[58] Field of Search ..... 338/157, 160, 338/158, 152, 143, 172, 162, 166, 175, 176, 202, 163

[56] References Cited

U.S. PATENT DOCUMENTS

| | | | |
|---|---|---|---|
| 1,785,779 | 12/1930 | Lauter . | |
| 2,141,770 | 12/1938 | Solomon | 338/202 |
| 2,309,798 | 2/1943 | Stoekle et al. | 338/157 |
| 2,492,727 | 12/1949 | Ballard . | |
| 2,912,662 | 11/1955 | Faymoreau | 338/157 |
| 2,993,184 | 7/1961 | Mims et al. . | |
| 3,151,307 | 9/1964 | Mairs . | |
| 3,310,768 | 7/1965 | Opalenik et al. | 338/202 |
| 3,332,060 | 7/1967 | Lilequist | 338/157 |
| 3,533,043 | 10/1970 | Spaude | 338/202 |
| 4,032,880 | 6/1977 | Di Michele et al. . | |
| 4,878,040 | 10/1989 | Tamura | 338/158 |

FOREIGN PATENT DOCUMENTS

| | | | |
|---|---|---|---|
| 246325 | 6/1926 | United Kingdom | 338/158 |
| 450549 | 7/1936 | United Kingdom | 338/157 |

*Primary Examiner*—Teresa J. Walberg
*Assistant Examiner*—Karl Easthom
*Attorney, Agent, or Firm*—Schwegman, Lundberg, Woessner & Kluth, P.A.

[57] ABSTRACT

The present invention provides a variable resistance device having at least one pair of channels retaining a conductive ball between them. The channels contain a resistive element and a conductive element and movement of the conductive ball within the channels, caused by rotation of the channels relative to each other, provides a variable resistance.

14 Claims, 2 Drawing Sheets

VARIABLE RESISTANCE DEVICE

FIELD OF THE INVENTION

The present invention relates to the field of devices for providing a variable resistance. More particularly, the present invention relates to a variable resistance device having at least one pair of channels retaining a conductive ball between them, wherein movement of the conductive ball within the channels provides a variable resistance.

BACKGROUND OF THE INVENTION

Variable resistance devices find many uses in electrical equipment. One common use of a variable resistance device is as a potentiometer to control volume in, for example, radios or hearing aids.

When used in a hearing aid, a potentiometer must meet a number of requirements. The foremost requirement is size. As hearing aids continue to decrease in size, their components must, necessarily, also decrease in size. This poses a problem for potentiometers which typically rely on electromechanical structures to provide variable resistance.

Many of the devices use a center screw around which one or more of the components rotate. As a result, the torque is concentrated and can lead to failure if excess torque is applied to the device.

Another problem faced in conjunction with hearing aids is that repair of the wide number of devices, each using different components, requires that repair centers stock a wide range of different potentiometers. As a result, the cost to repair the hearing aids is increased due to additional overhead associated with those stocks.

Known potentiometers also are typically constructed of a relatively large number of small parts, increasing the difficulty in assembly and, correspondingly, the cost of the devices. In addition, the reliability is impaired because of the likelihood that each of the many parts presents an opportunity for failure in the device.

One example of a known potentiometer is disclosed in U.S. Pat. No. 4,032,880 to De Michele et al. The device comprises a conductive ball trapped between a smooth resistive plate and a grooved conductive plate. The plates are rotated relative to each other to cause the ball to move on the resistive plate, thereby varying the resistance.

This device suffers from the problems discussed above. Namely, it is constructed from a relatively large number of components and uses a center screw connection which concentrates stress. In addition by using a smooth resistive plate, the ball can potentially stick or spin in place on the resistive plate, causing erroneous output.

SUMMARY OF THE INVENTION

The present invention provides a variable resistance device having at least one pair of channels retaining a conductive ball between them. The channels contain a resistive element and a conductive element and movement of the conductive ball within the channels, caused by rotation of the channels relative to each other, provides a variable resistance.

In one aspect, a preferred embodiment according to the present invention comprises a base having a substantially straight channel extending radially from a center of the base, a retainer rotatably attached to the base and having a curved channel extending from the center of the retainer, a conductive ball retained within each of the channels in the base and retainer, and conductive and resistive elements located in the channels. As a result, rotation of the retainer and its associated channel relative to the base and its associated channel causes the ball to move along the channels, thereby varying the resistance based on the position of the ball along the resistive element.

Advantages of the present invention include the ability to change the operating characteristics of the device, e.g., the change in resistance as a function of relative rotation, by substituting retainers having differently curved channels. The remainder of the device remains unchanged. As a result, a technician can stock a relatively small number of parts and yet provide devices having a wide range of operating characteristics.

Another advantage of the present invention is that the cooperation between the two channels forces the conductive ball to move as the base and retainer are rotated, eliminating the potential for the ball to remain in place.

Yet another advantage of the present invention is the relatively small number of parts used to construct the device. If the resistive and conductive elements are formed integral with the base and/or retainer, the number of parts need to assemble the device is four—a base, a retainer, a conductive ball and a retainer plug. The retainer plug may even be unnecessary in some designs, thereby reducing the number of parts for assembly to three.

A further advantage of the present invention is that the torque used to operate the device is distributed over a relatively large diameter as opposed to the concentration of torque in devices employing a central screw for transferring torque.

In another aspect, the present invention incorporates a switch for on/off operation of a secondary device in which the variable resistance device is installed.

These and other features and advantages accorded by the present invention will become apparent upon reference to the description of the preferred embodiments according to the present invention, drawings and claims appended hereto.

DETAILED DESCRIPTION OF THE PREFERRED EMBODIMENTS

Figure 1:
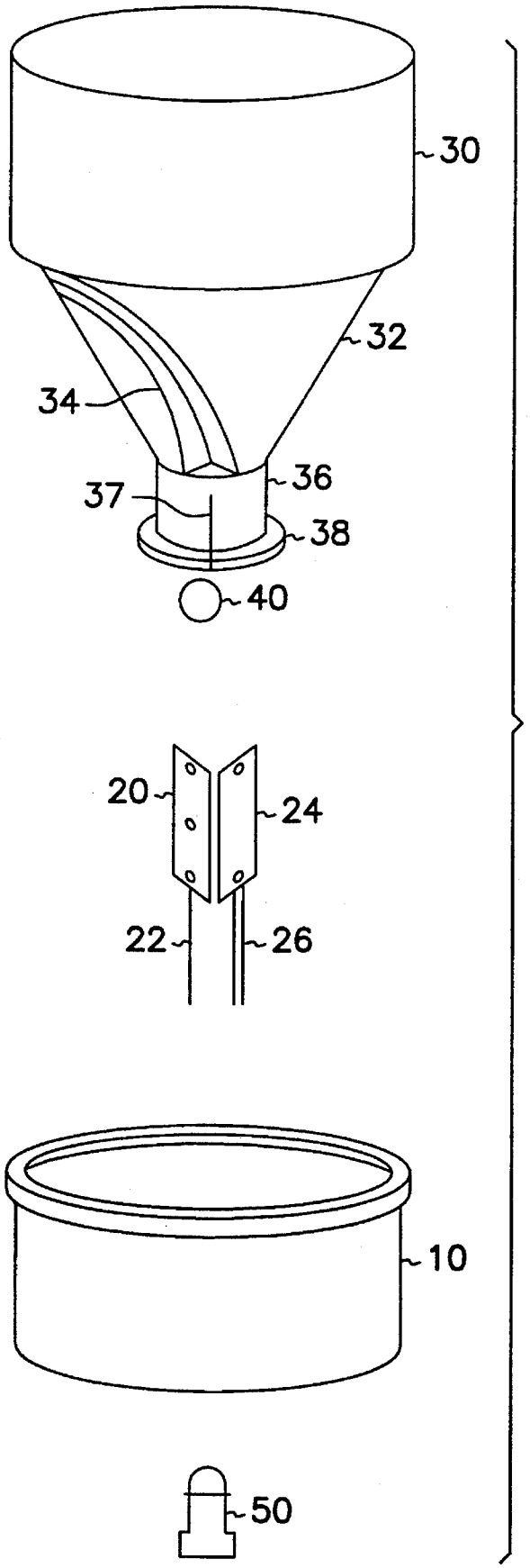
FIG. 1 is an exploded perspective view of one preferred embodiment of a variable resistance device according to the present invention.

One preferred embodiment of a device constructed according to the present invention includes a base 10, resistive element 20, conductive element 24, retainer 30, conductive ball 40 and retaining plug 50.

When assembled, the retainer 30 mates with the base 10. Base 10 preferably includes a channel 14 (see FIG. 2) which contains the resistive element 20 and conductive element 24 in a spaced apart relationship. Conductive ball 40 lies within the channel 14 to complete an electrical path between the resistive element 20 and the conductive element 24.

The base 10 and retainer 30 are preferably formed from any non-conductive material amenable to injection molding, although it will be understood that the parts could be formed from any suitable process. Also, the base 10 and retainer 30 could be formed from a conductive material such as a metal, provided that at least the resistive element 20 was insulated from the base 10 and, further, that channel 34 in the retainer 30 was also lined with a non-conductive material to prevent shorting of the circuit formed between the ball 40, resistive element 20 and conductive element 24.

The resistive element 20 is preferably formed from any material or combination of materials which provides accurate resistance along the length of element 20. In the preferred embodiment, resistive element 20 is an electrically resistive curable ink deposited on one side of the channel 14.

The conductive element 24 is formed of any material which provides a high level of electrical conductivity in relation to the resistive element 20. In the preferred embodiment the element 24 is formed of gold-plated stainless steel. In most situations, the conductive element 24 will preferably exhibit adhesion to solder and be highly conductive. One alternative formulation can include a full hard beryllium copper plated stainless steel element 24.

It is also preferred that both the resistive element 20 and the conductive element 24 exhibit durability during use as the conductive ball 40 moves along those elements.

Figure 2:
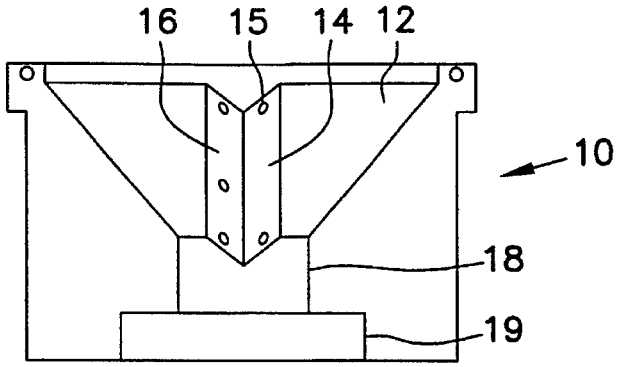
FIG. 2 is a cross-sectional view of the base in the device of FIG. 1.

As seen in FIG. 1, the device includes lead wires 22 and 26 which connect to the preferred resistive element 20 and conductive element 24, respectively. The lead wires 22 and 26 are threaded through bores 12 and 23 formed in base 10 as best seen in FIG. 2. Although only two leads are shown, any number of leads could be provided as required. Furthermore, it will be understood that any method of making electrical connections between the resistive element 20 and conductive element 24 could be used in place of the preferred lead wires 22 and 26.

In addition, it will also be understood that the resistive and conductive elements 20 and 24 could be molded into the base 10, along with any needed electrical connections during manufacture of the base 10.

The channel 34 in retainer 30 cooperates with the channel 14 in base 10 when assembled to retain the conductive ball 40 within channel 14. Those portions of channel 34 which contact conductive ball 40 are preferably non-electrically conductive.

The retainer 30 includes an extension 36 designed to fit through a corresponding bore 18 in base 10. Extension 36 includes retaining wings 38 and a compression slot 37 so that wings 38 can compress radially as retainer 30 is forced into the base 10. After wings 38 have been forced through bore 18, they can expand radially in area 19, thereby engaging retainer 30 in position relative to base 10, while still allowing the base 10 and retainer 30 to rotate relative to each other.

Plug 50 is placed in bore 39 (see FIG. 3) in extension 36 to ensure that wings 38 do not compress which could cause the retainer 30 to disengage from the base 10. It will be understood that plug 50 may be optional in some devices. Further, it will also be understood that other means of maintaining the base and retainer in operative engagement could be substituted for the extension 36 and plug 50 of the preferred embodiment such as threaded fasteners and equivalent structures.

Figure 3:
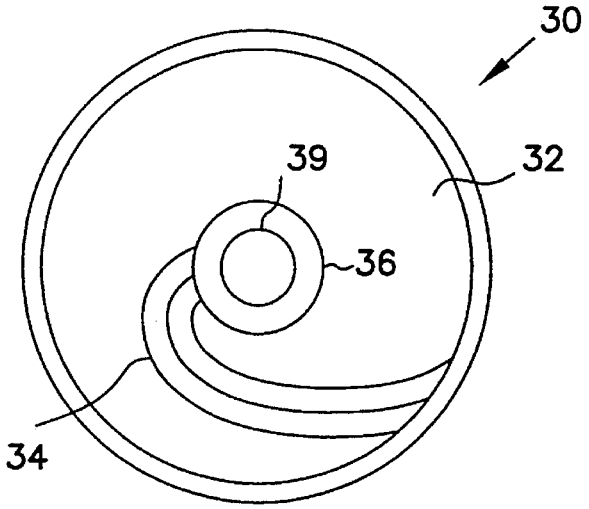
FIG. 3 is a bottom plan view of the retainer in the device of FIG. 1.

Referring to FIGS. 2 & 3, channel 14 in base 10 is preferably formed along a straight line extending radially from the center of base 10. Alternately, the channel 14 could be formed along a curved line. The straight line is, however, preferred because it simplifies manufacture and/or location of the resistive element 20 and conductive element 24.

Channel 34 in retainer 30 is preferably curved as shown in FIG. 3. The exact shape of the curve 34 is based on the desired characteristics of the device. A steeper, shorter path will result in a device in which a fraction of a turn of the retainer 30 relative to the base 10 causes conductive ball 40 to move along the full length of channel 14, while a shallower, more helical curve could provide a device in which a multiple number of turns are required to move the conductive ball 40 along the full length of channel 14. Furthermore, changes in the shape of channel 34 can produce a device which provides resistance which varies linearly, logarithmically, parabolically or any other predetermined relationship between resistance as a function of rotation with rotation of base 10 and retainer 30.

It is the variations in the curved channel which provide one of the advantages of the present invention, i.e., by replacing only one part in the device, the characteristics can be altered as required. As a result, a technician could maintain a suitable inventory of the various components of the device and combine them as required to complete devices having the desired characteristics.

One consideration in designing the shape of channel 34 is that rotation of the retainer 30 relative to base 10 must produce a sufficient radial force on conductive ball 40 to move it along channel 14. As a result, it will be apparent that both channels cannot provided as straight radial lines, rather, at least one or both of the channels must be offset from a radial line to provide the necessary force to move a ball radially. In other words, if the base and retainer are formed as planar circular devices, one of the channels would be formed radially, whiled the channel in the opposite surface would be formed as a chord.

It will be understood that although a straight channel 14 is depicted in base 10 and a curved channel 34 in retainer 30, the straight channel could be formed in retainer 30 and the curved channel formed in base 10. In that situation, it may be desirable from a manufacturing standpoint to provide the resistive and conductive elements 20 and 24 in the straight channel, wherever it is located.

Alternately, it will be understood that the resistive element could be provided in channel 34 of the retainer 30 and the conductive element in channel 14 of the base 10 or vice versa. Whether the resistive and conductive elements are located within the same or different channels, the conductive ball will still complete the electrical circuit necessary to provide the variable resistance of the device.

As yet another alternative, the base 10 or retainer 30 could be formed of from a conductive material and would then function as the conductive element 24 to complete the circuit. In that embodiment, the separate conductive element 24 would not be required.

In yet another variation, the present device is not limited to a base 10 and retainer 30 which are formed as mating conical shapes, but could be provided as mating hemispheres, circular members lying in planes or any other mating geometric shapes which can be rotated to move a ball through a channel. The advantage to the conical or hemispherical shapes is the ability to provide a longer channel in a given amount of area perpendicular to the axis of rotation of the parts because the ball moves both along the axis as well as radially, thereby providing for a more accurate and sensitive device.

Further, it will be understood that the present invention could include a plurality of conductive balls, each retained within their own pair of corresponding channels in the same device.

Figure 4:
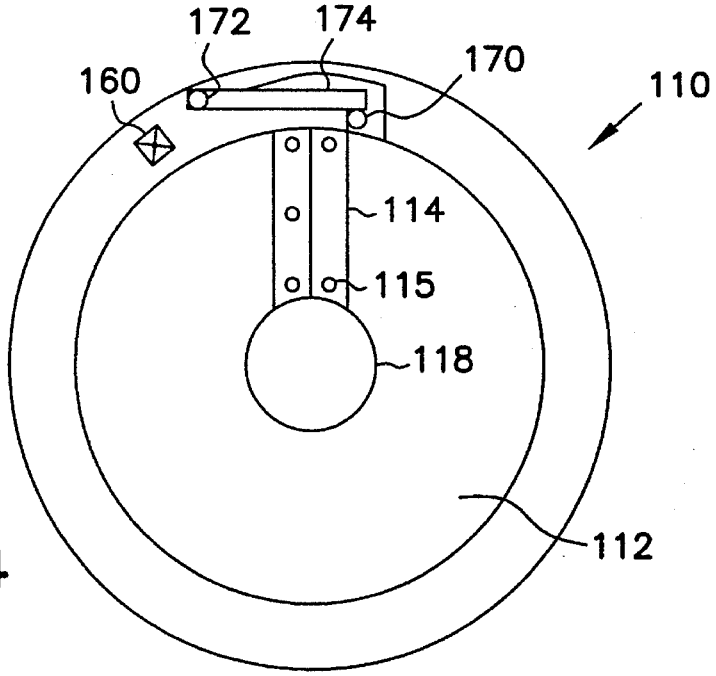
FIG. 4 is a top plan view of alternate preferred embodiment of a base for a device according to the present invention wherein the base includes a switch.

Referring now to FIG. 4, a top plan view of an alternate preferred embodiment of a base 110 is depicted which includes an integral switch formed therein. As with the base 10 depicted in FIGS. 1 & 2, base 110 in FIG. 4 includes a pair of contacts 170 & 172 proximate the outer edge of base 110. Member 174 is provided to complete a connection between contacts 170 & 172.

In the depicted embodiment, the switch is normally closed and pressure from a conductive ball riding in channel 114 would be used to force the member 174 away from contact 170, thereby opening the switch. The embodiment also preferably includes insulation between the ball and member 174 to prevent shorting of either the switching circuit or the resistive circuit.

To maintain the switch in the open position, a detent 160 is preferably provided in base 110 and corresponding structure is provided in a retainer mated with the base 110 to maintain the retainer and base 110 in relative positions in which a ball would force the switch open. Once the retainer were rotated to move a ball along channel 114, the switch would close, allowing operation of a hearing aid or other device. Although a detent is the preferred means of maintaining a retainer in the desired position relative to the base 110, it will be understood that alternate means of performing that function may be substituted.

Although specific embodiments have been illustrated and described herein, it will be appreciated by those of ordinary skill in the art that any arrangement which is calculated to achieve the same purpose may be substituted for the specific embodiments described. This application is intended to cover any adaptations or variations of the present invention. Therefore, it is manifestly intended that this invention be limited only by the claims and the equivalents thereof.

We claim:

1. A device for providing variable electrical resistance comprising:

a) a base having a top surface that is conical in shape, the top surface having a first channel therein, the first channel extending from proximate a center of the base towards the periphery of the base;

b) a retainer located directly above the top surface of the base, the retainer having a bottom surface that is conical in shape and which conforms to the shape of the top surface of the base, the retainer being coaxially aligned with and rotating about the center of the base;

c) the bottom surface having a second channel therein, the second channel being located proximate the top surface of the base, the second channel extending from proximate the center of the retainer towards the periphery of the retainer;

d) a resistive element located along one of the first and second channels;

e) a conductive element located along one of the first and second channels; the conductive element being insulated from the resistive element; and f) a conductive ball located within the first and second channels, the ball being in contact with each of the resistive and conductive elements, whereby the conductive ball moves along the first and second channels as the base and retainer are rotated relative to each other to provide a predetermined variable resistance based on the position of the conductive ball along the resistive element.

2. A device to claim 1, wherein the resistive and conductive elements are both located within one of the first and second channels.

3. A device according to claim 2, wherein the first channel is formed on the base along a substantially straight line extending substantially radially from proximate the center of the base toward the periphery of the base, the first channel having a first end located proximate the center of the base and a second end located near the periphery of the base.

4. A device according to claim 3, wherein the second channel is formed on the retainer along a curved line extending substantially radially from proximate the center of the retainer toward the periphery of the retainer, the second channel having a first end located proximate the center of the retainer and a second end located near the periphery of the retainer.

5. A device according to claim 1, further comprising an integral switch.

6. A device according to claim 5, wherein the integral switch is moved between open and closed by the conductive ball.

7. A device for providing variable electrical resistance comprising:

a) a base having a non-planar top surface including a curved surface portion;

b) a retainer located directly above the top surface of the base, the retainer having a non-planar bottom surface including a curved surface portion that conforms to the shape of the non-planar top surface of the base, the retainer rotating about the center of the base;

c) a first channel located in the curved surface portion of the top surface of the base and a second channel located in the curved surface portion of the bottom surface of the retainer, the first and second channels extending from proximate a center of the device towards a periphery of the device, said first channel being formed along a substantially straight line extending substantially radially from the center of the base, and the second channel being formed along a curved line extending from the center of the retainer towards the periphery of the retainer;

d) a resistive element located along the first channel;

e) a conductive element located along one of the first and second channels; the conductive element being insulated from the resistive element; and f) a conductive ball located within the first and second channels, the ball being in contact with each of the resistive and conductive elements, whereby the conductive ball moves along the first and second channels as the base and retainer are rotated relative to each other to provide a predetermined variable resistance based on the position of the conductive ball along the resistive element.

8. A device according to claim 7, wherein the resistive and conductive elements are both located within one of the first and second channels.

9. A device according to claim 8, further comprising an integral switch.

10. A device according to claim 9, wherein the integral switch is moved between open and closed by the conductive ball.

11. A device according to claim 7, further comprising an integral switch.

12. A device according to claim 11, wherein the integral switch is moved between open and closed by the conductive ball.

13. A device according to claim 7, wherein the top surface of the base is conical in shape and the bottom surface of the retainer is conical in shape and conforms to the shape of the top surface of the base.

14. A device according to claim 7, wherein the resistive element and the conductive element are both located in the first channel in the base, and wherein the second channel is helical in shape.

* * * * *